US006578223B1

(12) United States Patent
Link et al.

(10) Patent No.: US 6,578,223 B1
(45) Date of Patent: Jun. 17, 2003

(54) CONTAINER OPENING TOOL

(75) Inventors: Robert Andrew Link, Hamilton, IN (US); Deryl Thomas Webster, Angola, IN (US); Kenneth Matthew Schneider, Auburn, IN (US)

(73) Assignee: Vestil Manufacturing Corp., Angola, IN (US)

( * ) Notice: Subject to any disclaimer, the term of this patent is extended or adjusted under 35 U.S.C. 154(b) by 0 days.

(21) Appl. No.: 10/077,004

(22) Filed: Feb. 15, 2002

(51) Int. Cl.[7] ..... B67B 7/44
(52) U.S. Cl. ..... 7/156; 81/3.09
(58) Field of Search ..... 7/105, 151, 152, 7/153, 156, 158, 161, 169; 81/3.07, 3.09, 3.36, 3.55

(56) References Cited

U.S. PATENT DOCUMENTS

| | | | | | |
|---|---|---|---|---|---|
| 789,103 | A | | 5/1905 | Parker | |
| D45,644 | S | | 4/1914 | Michelin | |
| 1,582,442 | A | | 4/1926 | White | |
| 1,883,216 | A | | 10/1932 | Winters | |
| 2,103,008 | A | | 12/1937 | Kinast | |
| 2,964,763 | A | | 12/1960 | Nagy et al. | |
| D192,721 | S | | 5/1962 | Mills | |
| D244,575 | S | | 6/1977 | Endres et al. | |
| 4,216,685 | A | | 8/1980 | Taylor | |
| 4,234,988 | A | | 11/1980 | Ross et al. | |
| 4,398,314 | A | | 8/1983 | Converse et al. | |
| D271,275 | S | | 11/1983 | Richilano | |
| D276,304 | S | | 11/1984 | DiFede | |
| D276,585 | S | | 12/1984 | DiFede | |
| 4,492,132 | A | | 1/1985 | Obey | |
| 4,580,302 | A | * | 4/1986 | Barth | 7/152 |
| 4,658,455 | A | * | 4/1987 | Skillern | 7/105 |
| 4,747,173 | A | | 5/1988 | Marceau | |
| 4,829,619 | A | | 5/1989 | Edgerton | |
| D304,899 | S | * | 12/1989 | Liu | D8/23 |
| D304,992 | S | | 12/1989 | Matthies | |
| 4,967,436 | A | | 11/1990 | Russell | |
| 5,069,090 | A | | 12/1991 | Clark | |
| 5,121,661 | A | * | 6/1992 | Deplante et al. | 81/3.09 |
| 5,222,265 | A | | 6/1993 | Hermansson | |
| D337,492 | S | | 7/1993 | Ryan et al. | |
| 5,241,719 | A | * | 9/1993 | Memmelaar | 7/156 |
| D351,326 | S | | 10/1994 | Schwengel | |
| D359,220 | S | | 6/1995 | Vinar | |
| D382,180 | S | | 8/1997 | Chuang | |
| D393,195 | S | | 4/1998 | Rose, III | |
| 5,778,472 | A | * | 7/1998 | Lang | 7/156 |
| 5,931,059 | A | | 8/1999 | Hammer | |
| D420,269 | S | | 2/2000 | Ben-Moshe | |
| 6,041,460 | A | | 3/2000 | Cholewinski | |
| D422,860 | S | | 4/2000 | Vinar | |
| 6,199,452 | B1 | | 3/2001 | Vinar | |

* cited by examiner

*Primary Examiner*—Joseph J. Hail, III
*Assistant Examiner*—David B. Thomas
(74) *Attorney, Agent, or Firm*—Bose McKinney & Evans LLP

(57) ABSTRACT

A tool for opening and re-sealing containers is provided. The tool includes a body having a first end and a second end. The tool also includes a hook at the first end to engage holes in tabs of a first container to release a lid of the container. The tool further includes a splayed member at the second end having a gap to engage and re-seal the lid onto the container, a cut block to provide a fulcrum on which to leverage the body, and a leverage block to provide a fulcrum on which to leverage the body. The tool also includes a blade coupled to the body to operate in concert with the cut block to cut a lid of a second container to create tabs on the lid and a pry member mounted on the body configured to operate in concert with the leverage block to pry the tabs of the second container lids to release the lid of the second container.

55 Claims, 4 Drawing Sheets

CONTAINER OPENING TOOL

FIELD OF THE INVENTION

The present invention relates to tools for opening and closing various types of containers. More particularly, the present invention relates to a tool for opening and closing sealed plastic and metal buckets.

BACKGROUND AND SUMMARY OF THE INVENTION

Sealed buckets typically hold five gallons of a liquid and are used to contain and transport paint, tar, sealants, and other application liquids. The buckets come in two main varieties: metal and plastic. The buckets are re-sealable and are typically not able to be opened by hand alone.

Accordingly, a tool for opening and re-sealing containers is provided. The tool includes a body having a first end and a second end. The tool also includes a hook at the first end to engage holes in tabs of a first container to release a lid of the container. The tool further includes a splayed member at the second end having a gap to engage and re-seal the lid onto the container, a cut block to provide a fulcrum on which to leverage the body, and a leverage block to provide a fulcrum on which to leverage the body. The tool also includes a blade coupled to the body to operate in concert with the cut block to cut a lid of a second container to create tabs on the lid and a pry member mounted on the body configured to operate in concert with the leverage block to pry the tabs of the second container lids to release the lid of the second container.

According to another embodiment of the present invention, a tool for opening and re-sealing containers is provided. The tool includes a body, a hook, a blade, a pry member, and a splayed member having a gap, a first block, and a second block.

According to yet another embodiment of the present invention, a tool for opening and re-sealing containers is provided. The tool includes a first end having a hook and a second end having a splayed member having a gap.

According to another embodiment of the present invention, a tool for sealing containers is provided. The tool includes a body and a gap defined in the body, the gap being configured to engage a lid to seal the lid onto a container.

According to another embodiment of the present invention, a tool for opening containers is provided. The tool includes a body having a first side and a second side. The tool also includes a block connected to the body extending from the first side and a blade extending from the body wherein the body extends tangentially relative to a container during use of the blade.

Additional features of the present invention will become apparent to those skilled in the art upon consideration of the following detailed description of embodiments of the invention in conjunction with the associated drawings.

DETAILED DESCRIPTION OF THE EMBODIMENTS OF THE INVENTION

The embodiments described below are merely exemplary and are not intended to limit the invention to the precise forms disclosed. Instead, the embodiments were selected for description to enable one of ordinary skill in the art to practice the invention.

Figure 1:
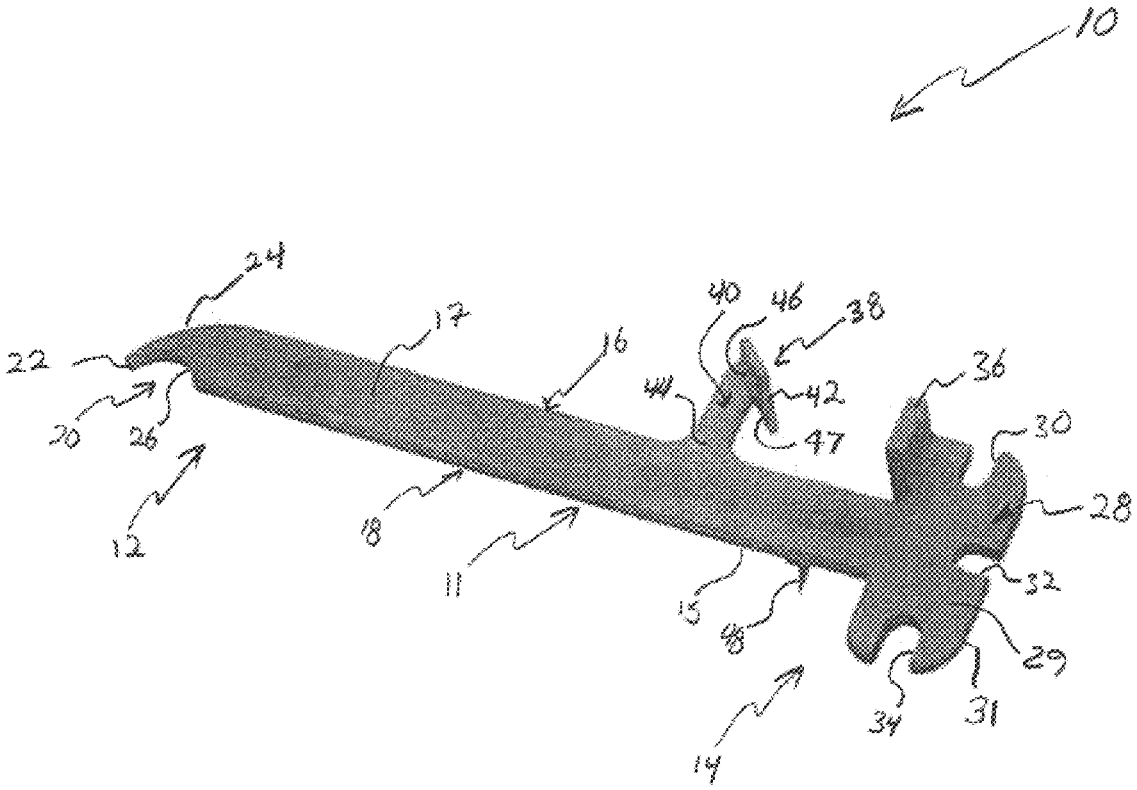
FIG. 1 is a perspective view of a tool according to one embodiment of the present invention.

FIG. 1 shows a container opening tool 10 according to the present invention that includes a body 11 that may be formed from an elongated corrosion-resistant metal piece defining a plane and having a first end 12, a second end 14, a first side 15, a second side 17, a top 16, and a bottom 18. First end 12 includes a hook 20 that tapers to a tip 22 at the end of hook 20. Hook 20 is formed by a combination of a convex arc surface 24 on top 16 and a concave arc surface 26 on bottom 18 that meet at tip 22. First end 12 may also have a hand grip (not pictured) that surrounds a portion of first end 12 of body 11. The hand grip is preferably made of rubber and does not extend over the hook 20.

Figure 6:
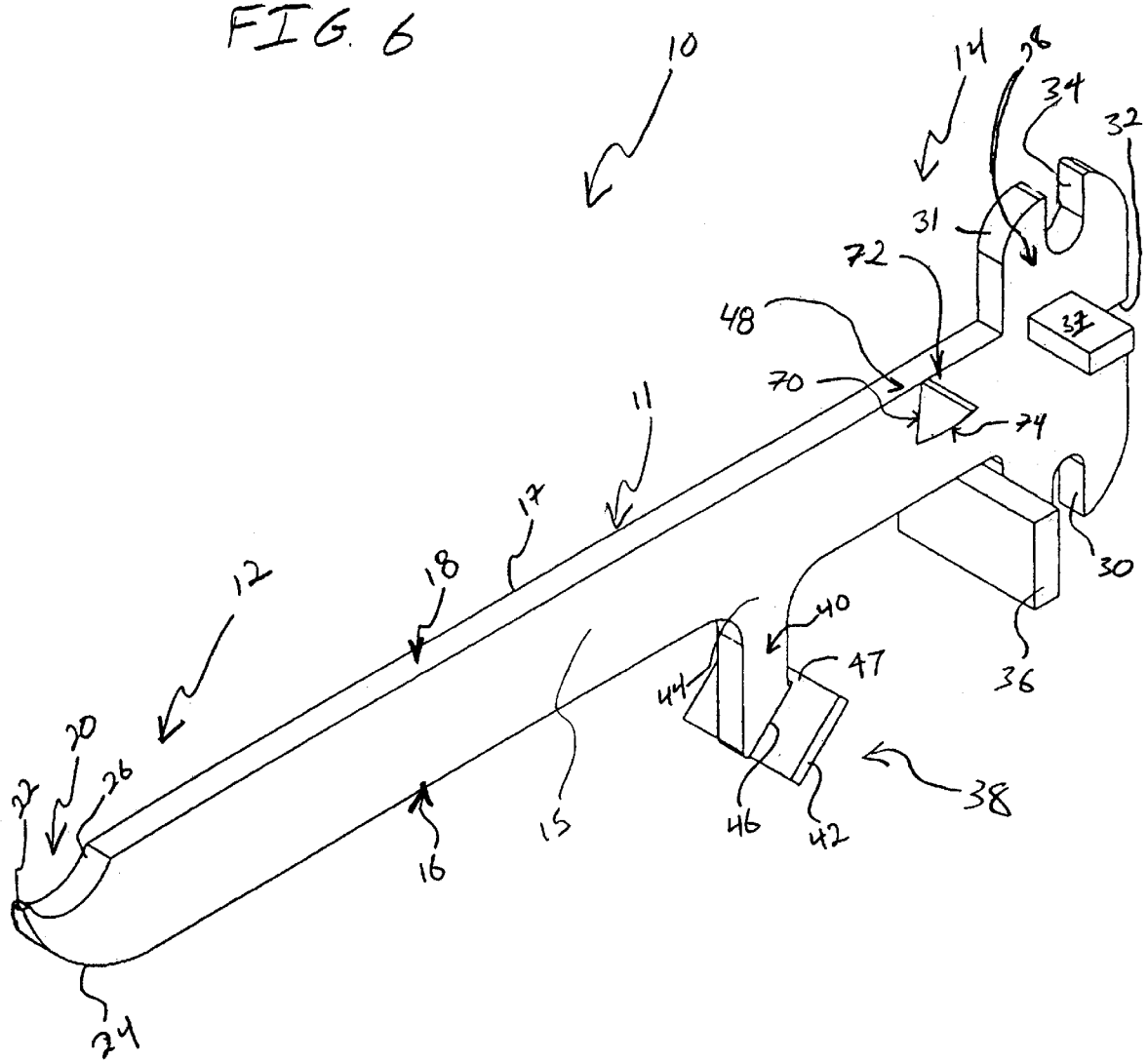
FIG. 6 is a perspective view of the tool of FIG. 1 from a reverse angle.

Second end 14 includes a splayed member 28. Splayed member 28 includes a plate 29 that is substantially planar with body 11, but extends in one direction beyond top 16 of body 11 and in another direction beyond bottom 18 of body 11. Plate 29 includes a plurality of U-shaped gaps 30, 32, 34 therein, a leverage block 36 attached thereto adjacent to top 16 of body 11, and a cut block 37 (FIG. 6) extending from first side 15 of body 11. Gap 30 is oriented 90 degrees from gap 32 that is likewise oriented 90 degrees from gap 34. Gap 30 is defined in the portion of plate 29 that extends beyond top 16 of body 11. Gap 34 is defined in the portion of plate 29 that extends beyond bottom 18 of body 11. Gap 32 is defined in the portion of body 29 that neither extends above nor below body 11. Each gap 30, 32, 34 is formed from an edge 31 of plate 29 inward. Each gap 30, 32, 34 includes a pair of straight, parallel walls that extend perpendicular to a portion of edge 31 of plate 29. The parallel walls converge in a smooth arc to form the U-shape of gap 30, 32, 34. Each gap 30, 32, 34 has a different opening width, that is the parallel walls of each gap 30, 32, 34 are differently spaced apart. The opening widths of gaps 30, 32, 34 are preferably 5/16", 3/8", and 7/16", respectively, and correspond to common widths of bucket rims. Leverage block 36 is a substantially rectangular piece that extends perpendicular to plate 29. Half of leverage block 36 extends in the direction of first side 15 of tool 10 and half of leverage block 36 extends in the direction of second side 17 of tool 10.

Tool 10 also includes a pry wedge 38 extending from top 16 of body 11 of tool 10. Pry wedge 38 includes an extension 40 extending from body 11 and a pry plate 42 attached to extension 40. Extension 40 may be a flat metal piece that lies in the same plane as body 11. Extension 40 may be integral or attached to body 11. Extension 40 has a first end 44 that extends from top 16 of body 11 and a second end 46 that terminates to form approximately a forty-five-degree angle relative to top 16 of body 11. Pry plate 42 may be a substantially flat, rectangular piece of metal. Second end 46 attaches to pry plate 42 such that pry plate 42 also forms an angle of approximately forty-five-degrees relative to top 16 of body 11. Half of the length of pry plate 42 extends in the direction of first side 15 of tool 10 and half of pry plate 42 extends in the direction of second side 17 of tool 10. Further, the width of pry plate 42 is greater than the width of second end 46 of extension 40 such that an edge 47 of pry plate 42 nearest top 16 of tool 10 extends beyond extension 40. Edge 47 thereby forms a lifting surface to engage the underside of tabs 108 as further described below.

Tool 10 also includes a blade 48. Blade 48 may be a thin piece of metal capable of cutting through plastic. Blade 48 is mounted on or extends from first side 15 of body 11 so as to be perpendicular to body 11. Blade 48 is mounted between pry plate 42 and leverage block 36 as shown in FIG. 1. Blade 48 is shaped substantially as a right triangle. One edge 70 of the triangle is against first side 15 of body 11. A second edge 72 of the triangle is parallel with bottom 18 of body 11. The hypotenuse 74 of the triangle is slightly rounded. The second edge 72 is preferably sharpened.

Figure 2:
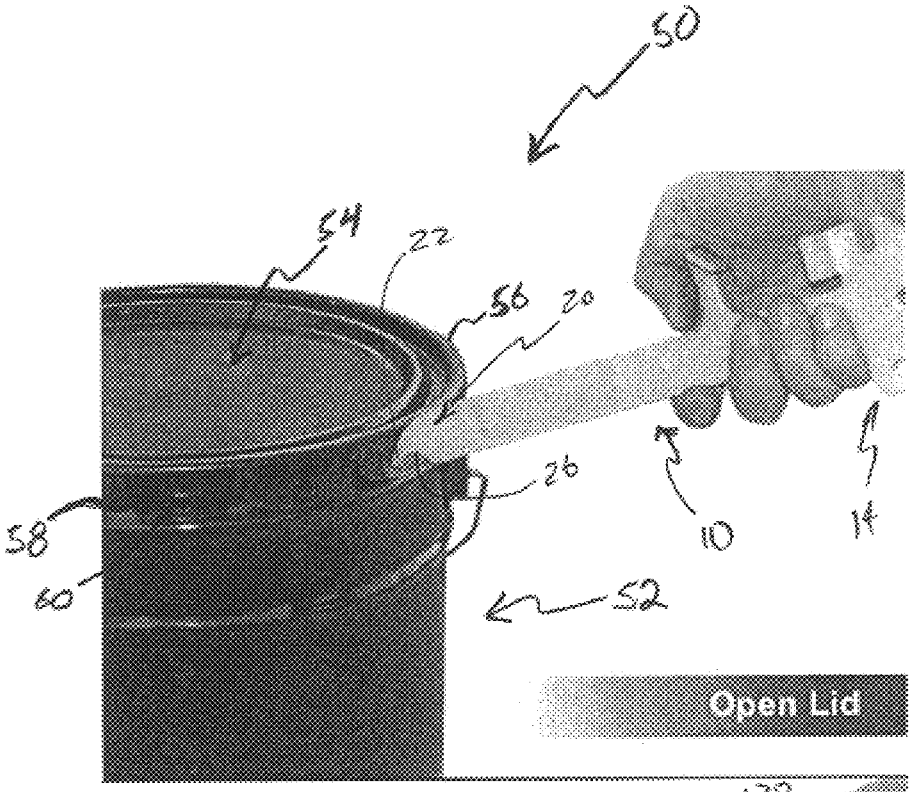
FIG. 2 is a perspective view of the tool of FIG. 1 in use prying tabs of a metal bucket.
Figure 3:
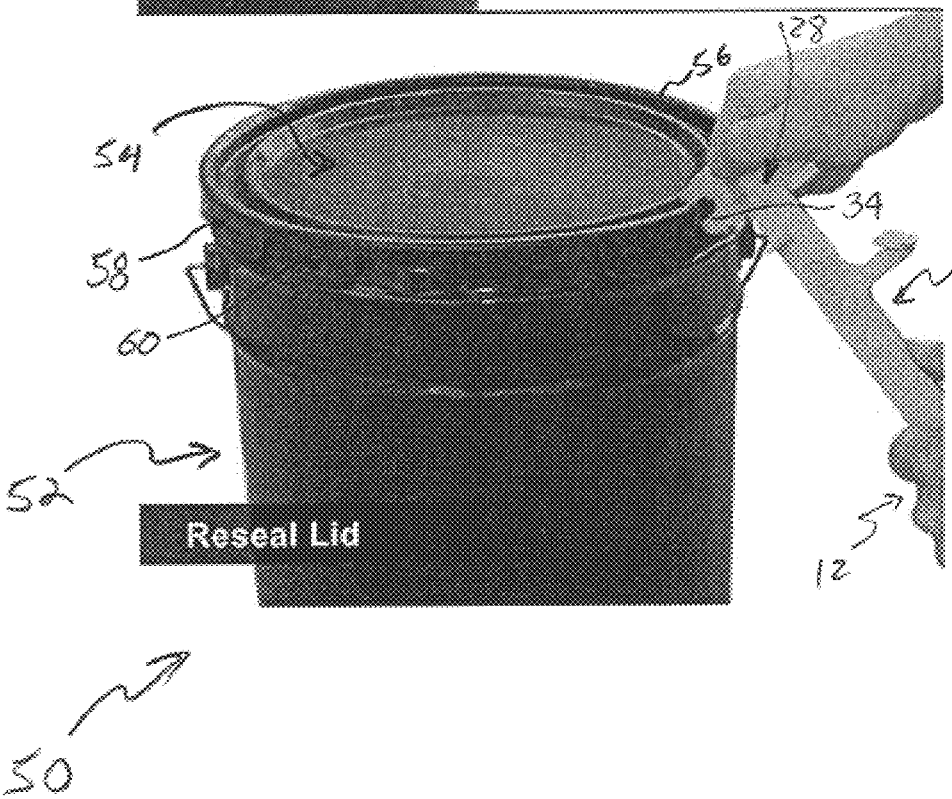
FIG. 3 is a perspective view of the tool of FIG. 1 in use re-sealing a metal bucket.

A metal pail or bucket 50, as shown in FIGS. 2 and 3, includes a container portion 52 and a lid 54. Lid 54 includes a rim 56 including a plurality of tabs 58. Rim 56 defines an annular groove (not pictured) on the underside of lid 54 that fits over an edge (not pictured) of container portion 52. Tabs 58 have holes 60 defined therein. To open metal bucket 50, at least some of tabs 58 must be bent upwards such that tabs 58 no longer contact container portion 52 of bucket 50. Further, bending the tabs 58 upwards widens the annular groove of rim 56 such that the groove does not snugly engage the upper edge of container portion 52.

Tool 10 is used to open bucket 50 by inserting tip 22 of hook 20 into hole 60 of a tab 58 such that concave arc surface 26 of hook 20 is facing downward as shown in FIG. 2. Second end 14 of tool 10 is then raised and used as a lever to bend up tab 58. After all tabs 58, or at least a significant portion of tabs 58, are bent upwards in this manner, lid 54 may be removed.

When bucket 50 needs to be closed and re-sealed, gaps 30, 32, 34 of splayed member 28 are used as shown in FIG. 3. Each of gaps 30, 32, 34 are of different sizes, and correspond to a standard width or thickness of a bucket rim 56. Depending on the size of rim 56 of a particular lid 54, the proper gap 30, 32, 34 is used to bend tabs 58 back into contact with container portion 52 of bucket 50 and to decrease the width of the annular groove as shown in FIG. 3. To bend tabs 58 down, a side of gap 30, 32, 34 is placed on an interior side of rim 56. First end 12 of tool 10 is then moved such that gap 30, 32, 34 contacts an exterior side of rim 56 and tab 58. Leverage is then applied downwardly, as viewed in FIG. 3, at first end 12 of tool 10 to rotate tabs 58 back into contact with container portion 52 of bucket 50 and to decrease the width of the annular groove, thereby re-sealing bucket 50.

Figure 4:
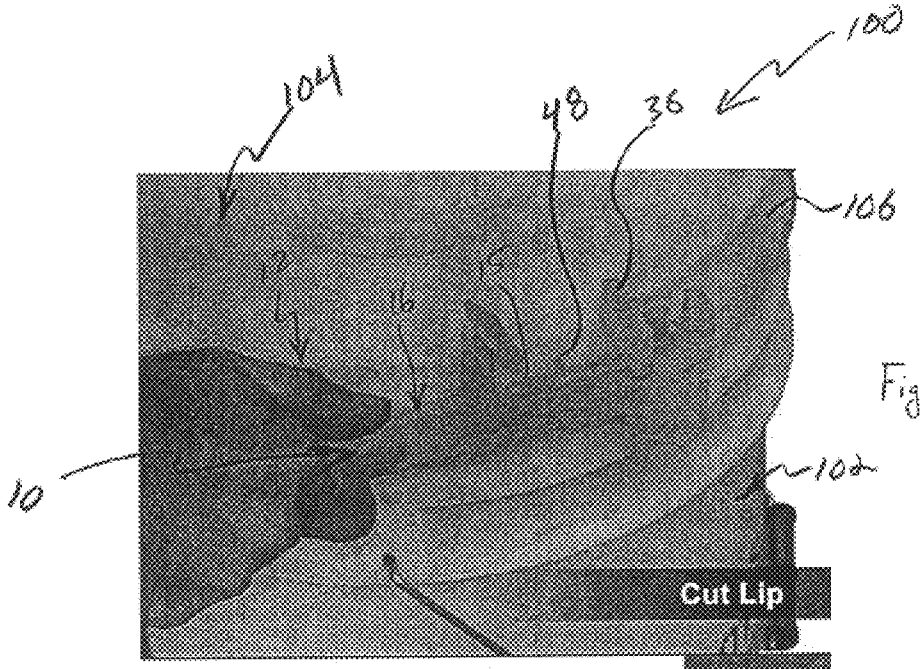
FIG. 4 is a perspective view of the tool of FIG. 1 in use cutting a plastic bucket.
Figure 5:
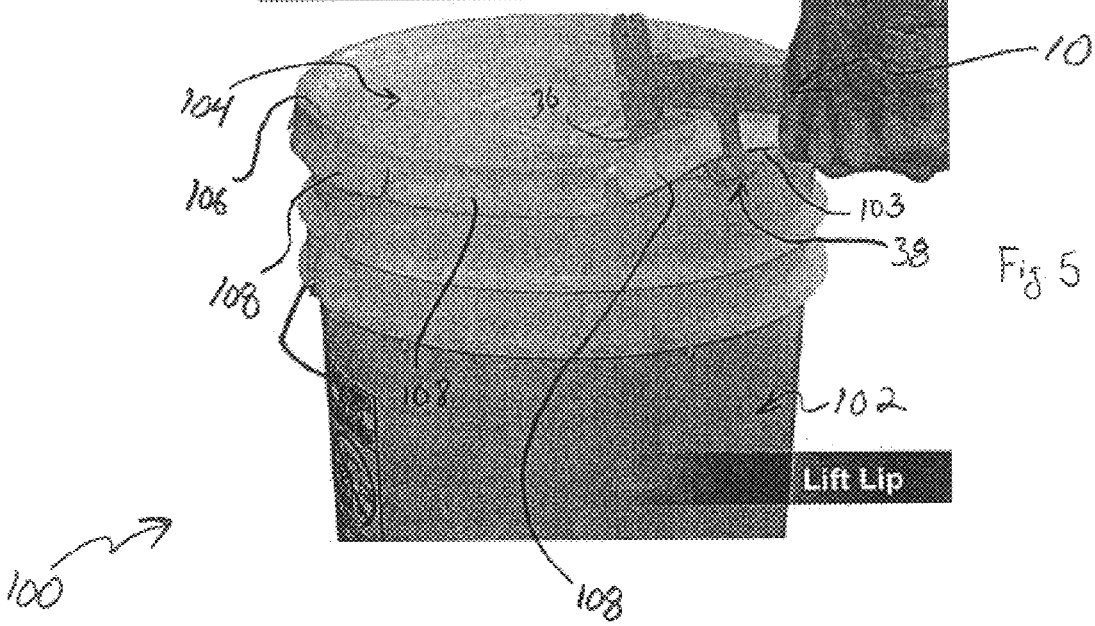
FIG. 5 is a perspective view of the tool of FIG. 1 in use opening a plastic bucket.

A plastic bucket 100, as shown in FIGS. 4 and 5, also has a container portion 102 and a lid 104. Lid 104 includes a rim 106 and container portion 102 includes a corresponding rim or upper edge 103 shown in FIG. 5. Rim 106 of lid 104 fits onto upper edge 103 of container portion 102 such that lid 104 is coupled to container portion 102 to provide a perimeter seal along upper edge 103 of container portion 102. When plastic bucket 100 is first encountered, rim 106 of lid 104 is a substantially solid ring. In order to remove lid 104, rim 106 is cut into tabs 108. To cut rim 106 into tabs 108, tool 10 is placed against lid 104 as shown in FIG. 4 such that cut block 37 (not shown in FIG. 4) is on top of rim 106, top 16 of tool 10 is facing upwards, first side 15 of tool 10 is facing lid 104, and blade 48 is below rim 106. First end 12 of tool 10 is then raised upwards as a lever utilizing cut block 37 as a fulcrum such that edge 72 of blade 48 engages rim 106 and makes a cut therein. Tabs 108 are created by repeating this operation, making cuts at spaced apart locations about the perimeter of rim 106.

Once tabs 108 are created, tabs 108 are disengaged from rim 106 of container portion 102 of bucket 100. To this end, leverage block 36 is placed on top of lid 104 on the interior side of rim 106 as shown in FIG. 5. Pry wedge 38 is placed below a tab 108 and then raised such that edge 47 of wedge 38 is placed between tab 108 and container portion 102. As first end 12 of tool 10 is further raised, pry wedge 38 pulls tab 108 outward and upward from container portion 102 of bucket 100, disengaging a portion of rim 106 from upper edge 103. After all tabs 108, or at least a significant portion of tabs 108, have been pulled up, lid 104 may be removed from container portion 102. Bucket 100 may be re-sealed by placing lid 104 on the container portion 102 and applying downward pressure such that rim 106 of lid 104 snaps onto or reengages upper edge 103 to secure lid 104 to container portion 102.

Although the invention has been described in detail with reference to preferred embodiments, variations and modifications exist within the scope and spirit of the invention as described and defined in the following claims.

What is claimed is:

1. A tool for opening and re-sealing containers including:

a body including a first end and a second end;

a hook at the first end to engage holes in tabs of a first container to release a lid of the container;

a splayed member at the second end having a gap to engage and re-seal the lid onto the container; a first block to provide a fulcrum on which to leverage the body, and a second block to provide a fulcrum on which to leverage the body;

a blade coupled to the body to operate in concert with the first block to cut a lid of a second container to create tabs on the lid; and a pry member mounted on the body configured to operate in concert with the second block to pry the tabs of the second container lid to release the lid of the second container.

2. The tool of claim 1, wherein the splayed member includes a plurality of gaps to re-seal the lid onto the second container.

3. The tool of claim 2, wherein each of the plurality of gaps is U-shaped.

4. The tool of claim 2, wherein each of the plurality of gaps is of a different opening width.

5. The tool of claim 2, wherein there is a ninety degree rotational displacement between adjacent gaps.

6. The tool of claim 1, wherein the tool is made of corrosion resistant metal.

7. The tool of claim 1, wherein the second block is a substantially rectangular metal block mounted perpendicularly relative to the splay ed member.

8. The tool of claim 1, the body further defining a plane, wherein the plane of the body bisects the second block.

9. The tool of claim 1, the pry member including an extension and a pry plate.

10. The tool of claim 9, wherein the extension is disposed between the body and the pry plate.

11. The tool of claim 9, the body further including a top, wherein the pry plate forms a forty-five degree angle relative to the top of the body.

12. The tool of claim 9, wherein the pry plate is mounted perpendicularly on the extension.

13. The tool of claim 9, the extension defining a plane wherein the pry plate is bisected by the plane of the extension.

14. The tool of claim 13, the body defining a plane wherein the plane of the body and the plane of the extension are substantially coplanar.

15. The tool of claim 1, wherein the hook includes a convex surface and a concave surface that meet at a tip.

16. The tool of claim 15, the body further including a top and a bottom, wherein the concave surface is on the bottom of the body and the convex surface is on the top of the body.

17. The tool of claim 1, wherein the blade is triangular.

18. The tool of claim 1, wherein the blade includes a sharpened edge.

19. The tool of claim 1, wherein the blade is attached to a first side of the body.

20. The tool of claim 19, wherein an edge of the blade is aligned with a bottom of the body.

21. The tool of claim 1, wherein the first block extends perpendicularly from the splayed member.

22. The tool of claim 21, the splayed member and the body defining a first side, wherein the first block and the blade both are both located on the first side.

23. A tool for opening and re-sealing containers including:

a body;

a hook;

a splayed member having a gap, a first block, and a second block, the gap configured to engage a lid to seal the lid onto a container;

a blade; and a pry member.

24. The tool of claim 23, wherein the splayed member includes a plurality of gaps.

25. The tool of claim 24, wherein each of the plurality of gaps is U-shaped.

26. The tool of claim 24, wherein each gap of the plurality of gaps has an opening width that is different from the opening widths of the other gaps of the plurality of gaps.

27. The tool of claim 23, wherein the first block is substantially rectangular and mounted on the splayed member in a perpendicular orientation relative to the splayed member.

28. The tool of claim 23, the body further defining a plane, wherein the plane of the body bisects the first block.

29. The tool of claim 23, the pry member including an extension and a pry plate.

30. The tool of claim 29, wherein the extension is disposed between the body and the pry plate.

31. The tool of claim 29, wherein the pry plate is mounted perpendicularly on the extension.

32. The tool of claim 29, the extension defining a plane wherein the pry plate is bisected by the plane of the extension.

33. The tool of claim 32, the body defining a plane wherein the plane of the body and the plane of the extension are substantially coplanar.

34. The tool of claim 23, wherein the hook includes a convex surface and a concave surface that meet at a tip.

35. The tool of claim 34, the body further including a top and a bottom, wherein the concave surface is on the bottom of the body and the convex surface is on the top of the body.

36. The tool of claim 23, wherein the blade is triangular.

37. The tool of claim 23, wherein the blade includes a sharpened edge.

38. The tool of claim 23, wherein the blade is attached to a first side of the body.

39. The tool of claim 23, wherein an edge of the blade is aligned with a bottom of the body.

40. The tool of claim 23, wherein the second block extends perpendicularly from the splayed member.

41. The tool of claim 40, the splayed member and the body defining a first side, wherein the second block and the blade both are both located on the first side.

42. A tool for opening and re-sealing containers including, a first end having a hook; and a second end having a splayed member, the splayed member having a gap, the gap configured to engage a lid to seal the lid onto a container.

43. The tool of claim 42, wherein the splayed member has a plurality of gaps defined therein configured to re-seal a lid of a container.

44. The tool of claim 43, wherein each of the plurality of gaps is substantially U-shaped.

45. The tool of claim 43, wherein each gap has a unique opening width.

46. The tool of claim 43, wherein there is a ninety-degree rotational displacement between adjacent gaps.

47. The tool of claim 43, further including a body extending between the first and second ends, the body and the splayed member being of unitary construction.

48. The tool of claim 44, wherein the hook includes a convex surface and a concave surface that meet at a tip.

49. The tool of claim 48, the body further including a top and a bottom, wherein the concave surface is on the bottom of the body and the convex surface is on the top of the body.

50. A tool for sealing containers including, a body, and a gap defined in the body, the gap configured to engage a lid to seal the lid onto a container.

51. The tool of claim 50 wherein, the body has a plurality of gaps configured to seal the container lid.

52. The tool of claim 51, wherein each of the plurality of gaps is substantially U-shaped.

53. The tool of claim 51, wherein each gap has a unique opening width.

54. The tool of claim 50, further including a hook, wherein the hook is integral with the body.

55. A tool for opening containers including:

a body, including first and second sides;

a block connected to the body extending from the first side; and a blade extending from the body the blade being triangular;

the body extending tangentially relative to the container during use of the blade.

* * * * *